US005888092A

United States Patent [19]

Chang

[11] Patent Number: 5,888,092

[45] Date of Patent: Mar. 30, 1999

[54] ELECTRICAL CONNECTOR HAVING DETECTION MEANS

[75] Inventor: Yao-Hao Chang, Chung-Ho, Taiwan

[73] Assignee: Hon Hai Precision Ind. Co., Ltd., Taipei Hsien, Taiwan

[21] Appl. No.: 879,622

[22] Filed: Jun. 20, 1997

[30] Foreign Application Priority Data

Jun. 22, 1996 [TW] Taiwan ..... 85209379

[51] Int. Cl.[6] ..... H01R 3/00

[52] U.S. Cl. ..... 439/489; 439/188

[58] Field of Search ..... 439/188, 488, 439/489, 490, 607

[56] References Cited

U.S. PATENT DOCUMENTS 5,647,754 7/1997 Kohno ..... 439/489 X 5,651,693 7/1997 Fukuda et al. ..... 439/188 X 5,672,073 9/1997 Matsumura et al. ..... 439/489

*Primary Examiner*—Khiem Nguyen

[57] ABSTRACT

An electrical connector comprises an insulating housing having a mating body and a plurality of passageways defined in the mating body; a plurality of conductive contacts received in the plurality of passageways; and detection means received in the mating body for detecting engagement of an external mating connector. The detection means comprises a main plate for inserting into a slot of a housing for an electrical connector and a pair of contact leg extending rearward from edges of the main plate for engaging conductive contacts of a mating connector.

30 Claims, 6 Drawing Sheets

ELECTRICAL CONNECTOR HAVING DETECTION MEANS

BACKGROUND OF THE INVENTION

1. Field of the Invention

The invention relates to an electrical connector having detection means and detection means for such an electrical connector.

2. The Prior Art

With the prevailing of the computer network systems, more and more attentions are cast onto the reliability of network systems and a series of electrical connection testings will be performed before normal use of the network systems. In conventional network systems, electrical connection testings are performed after all the mechanical connections of the systems are carried out. Since a network system may involve many peripherals, once a malfunction is found after the mechanical connections are completed, the system builder has to sequentially inspect each of the mechanical connections between the network system and the peripherals to locate the error causing the malfunction. This trouble-shooting process is very tedious and time-consuming. Hence, there is a need for an electrical connector having detection means for real-timely detecting the electrical connection between a network system and a peripheral to overcome the above-mentioned problem.

SUMMARY OF THE INVENTION

Accordingly, a main object of the present invention is to provide an electrical connector having detection means for real-timely detecting the electrical connection between a network system and a peripheral.

Another object of the present invention is to provide an electrical connector having detection means for detecting the electrical connection between the apparatus connected together.

To fulfill the above-mentioned objects, according to one embodiment of the present invention, an electrical connector comprises an insulating housing having a mating surface, a mating body extending forward from the mating surface, and a plurality of passageways defined in the mating body; a plurality of conductive contacts received in the plurality of passageways; and detection means received in the mating body for detecting engagement of an external mating connector.

In another embodiment, the electrical connector further comprises conductive shielding means conforming to a lateral surface of the mating body for prevention of electromagnetic interference; an insulating plate configured to provide on the insulating housing and at a rear side of the mating body insulating plate, including a plurality of vertical apertures for extending therethrough of a rear portion of the conductive contacts bent 90 degrees relative to a front portion thereof; a metal bracket for supporting the insulating housing and the insulating plate, the metal bracket defining a central opening for passing of the mating body; and a pair of insulating blocks extending rearward from both ends of the rear side of the mating body for securing the insulating housing and the metal bracket together.

In still another preferred embodiment, the present invention comprises an arrangement of detection means in an insulating housing for an electrical connector. The housing comprises a plurality of passageways and a slot near at least one of the passageways and communicating the at least one passageway and at least one conductive contact received in the at least one passageway. The detection means includes a main plate received in the slot and a first contact leg extending rearward from an edge of the main plate into an interior of the slot, the first contact leg having an outward convex portion bulging into the at least one passageway for engaging an external conductive contact inserted into the at least one passageway.

In one aspect, the present further comprises a detection means for an electrical connector. The detection means comprises a main plate for inserting into a slot of a housing for an electrical connector and a first contact leg extending rearward from an edge of the main plate for engaging a conductive contact.

These and additional objects, features, and advantages of the present invention will be apparent from a reading of the following detailed description of the embodiments of the invention taken in conjunction with the appended drawing figures, which are described briefly immediately below.

DETAILED DESCRIPTION OF THE PREFERRED EMBODIMENTS

Figure 1:
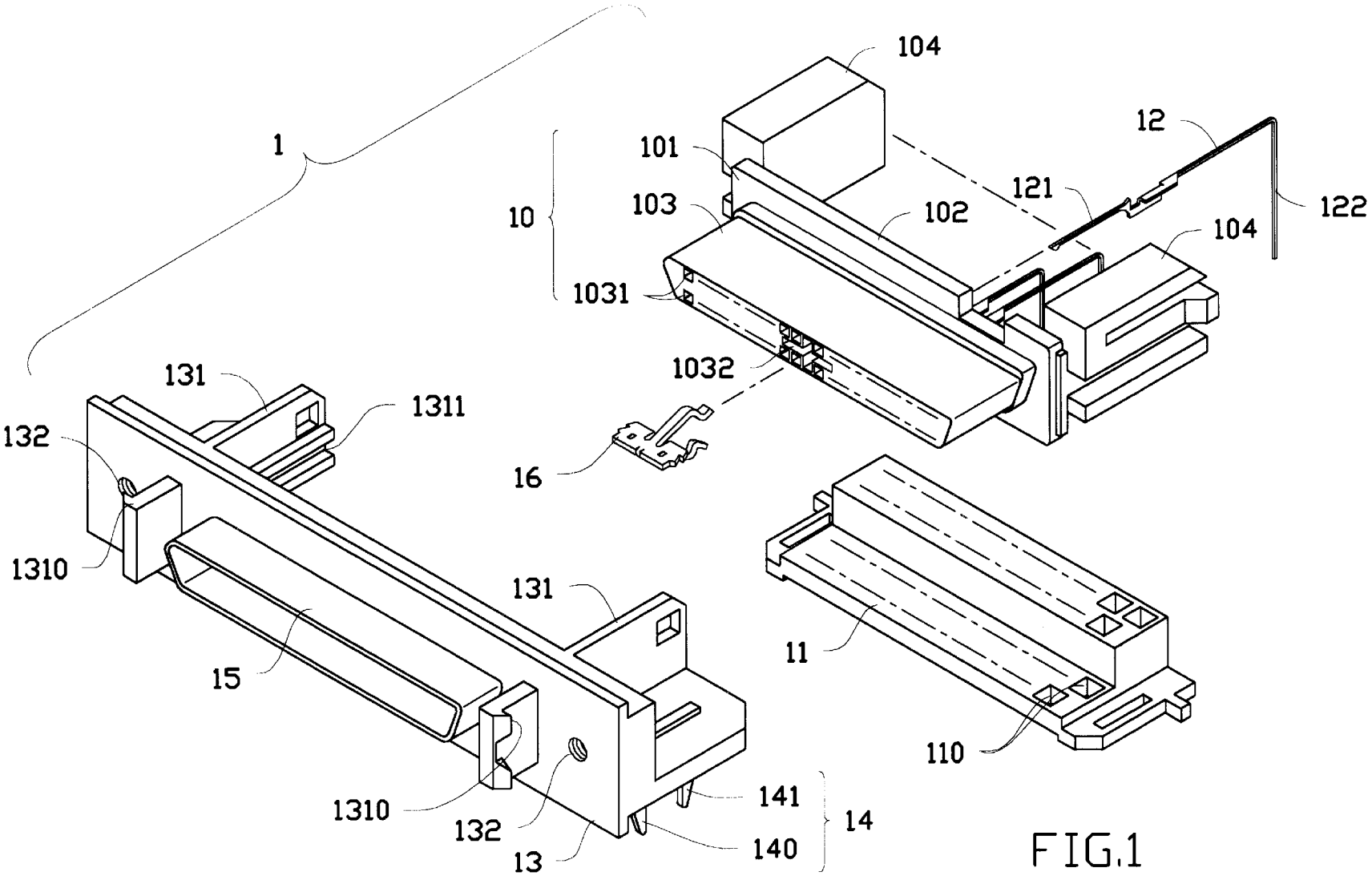
FIG. 1 shows an exploded perspective view of an electrical connector having detection means according to one preferred embodiment of the present invention.

Reference will now be made in detail to the preferred embodiments of the present invention. It will be noted here that for a better understanding, most of like components are designated by like reference numerals throughout the various figures in the embodiments.

Referring now to FIG. 1, an electrical connector having detection means according to the present invention is generally designated at 1. The boardlock 1 mainly comprises an insulating housing 10, an insulating plate 11, a plurality of conductive contacts 12, a metal bracket 13, boardlocks 14, shielding means 15 and detection means 16.

The insulating housing 10 comprises a front mating surface 101, a rear mounting surface 102 opposed the mating surface 101, and a mating body 103 extending forward from the mating surface 101. An upper and a lower row of passageways 1031 (only a few being shown) are defined in the mating body 103 for receiving a portion of the contacts 12.

A horizontal slot 1032 is provided in the mating body 103 between the upper and lower rows of passageways 1031 and communicating one upper and one passageway 1031 as means for positioning the detection means 16. In one preferred embodiment, the upper and lower passageways 1031 align with each other and a pair of aligned upper and lower passageways 1031 communicate the horizontal slot 1032, forming a cross opening on the front surface of the mating body 103.

A pair of insulating blocks 104 extends rearward form both ends of the rear mounting surface 102 of the insulating housing 10 for isolating contacts 12 on either side from the metal bracket 13 and for fixing the insulating housing 12 to the metal racket 13.

The insulating plate 11, configured to cooperate with the insulating blocks 104, is provided at the rear side of the insulating housing 10. In one preferred embodiment, the insulating plate 11 is customized to have an upper and a lower step, each including a plurality of vertical apertures 110 for extending therethrough of the contacts 12. As can be seen, in the present embodiment, the horizontal contacts 12 (only one contact being shown) are bent 90 degrees to be vertically downward at its rear portion 122 for passing through the apertures 110 of the insulating plate 11.

The metal bracket 13 is substantially an elongate plate defining a central opening (not shown) for passing through of the mating body 103. The metal bracket 13 further comprises a pair of supports 131 extending rearward of both sides thereof for connecting to the pair of insulating blocks 104. The support 131 includes a vertical plate a distance away from an end of the metal bracket 13 and a horizontal plate extending outward from a lower portion of the vertical plate.

The vertical plate defines a horizontal inward facing guide slot 1311 for guiding an outward facing guide bar (not labeled) on the insulating block 104 and a locking opening (not labeled) above the guide slot 1311 for locking an outward protrusion (not labeled) on the insulating blocks 104 above the guide bar. The horizontal plate comprises the boardlock 14 having a pair of legs 140, 141 for fixing on to a circuit board.

The metal bracket 13 further comprises a pair of hooks 1310 extending forward near both sides thereof for connecting to a mating connector (not shown) and a pair of screw holes 132 on both end portions thereof for further firmly securing the mating connector to the present connector 1.

The shielding means 15 is a metal shell provided on a front surface of the metal bracket 13 surrounding the central opening of the metal bracket 13.

Figure 3:
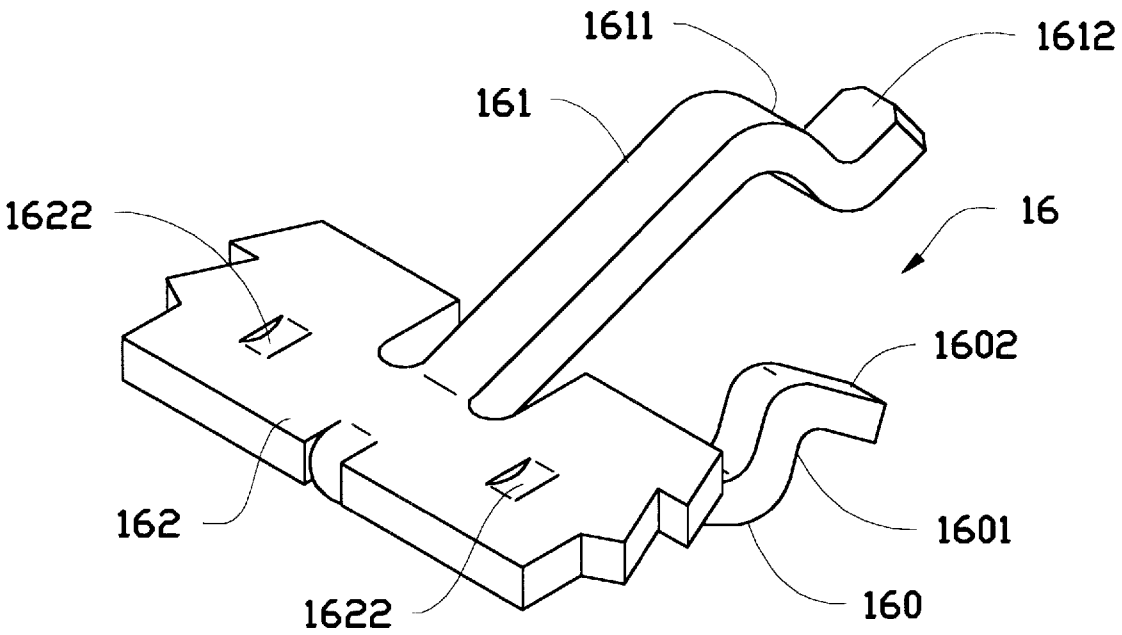
FIG. 3A shows a perspective view of detection means according to one preferred embodiment of the present invention.
FIG. 3B shows a lateral cross-sectional view of an detection means of FIG. 3A.
Figure 3:
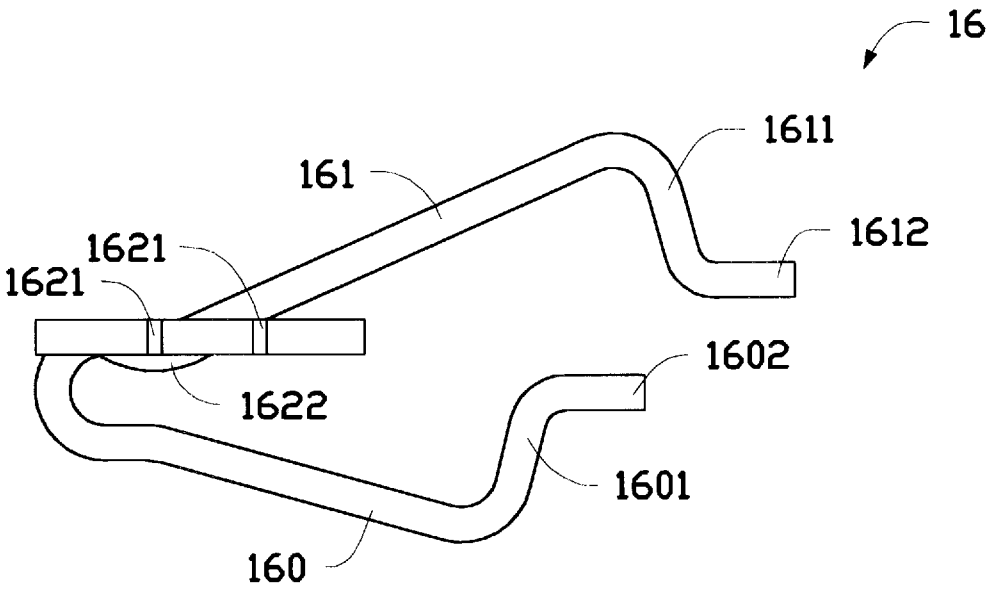

Please now further refer to FIGS. 3A and 3B. The present detection means 16 comprises a main plate 162 and a first lower and a second upper contact leg 160, 161. The lower contact leg 160 extends from a central front edge of the main plate 162 and directly bends rearward and downward to a convex portion 1601, and then continuously bends twice in opposite directions to form a V-shaped end having an end stopper 1602. The upper contact leg 161 extending rear from a central rear edge of the main plate 162, bends upward and, similar to the lower contact leg 160, includes a convex portion 1611 and a V-shaped end having an end stopper 1612. The main plate 162 further comprises a plurality of barbs 1621 on its lateral edges and a pair of embossments 1622 on its surface.

Figure 2:
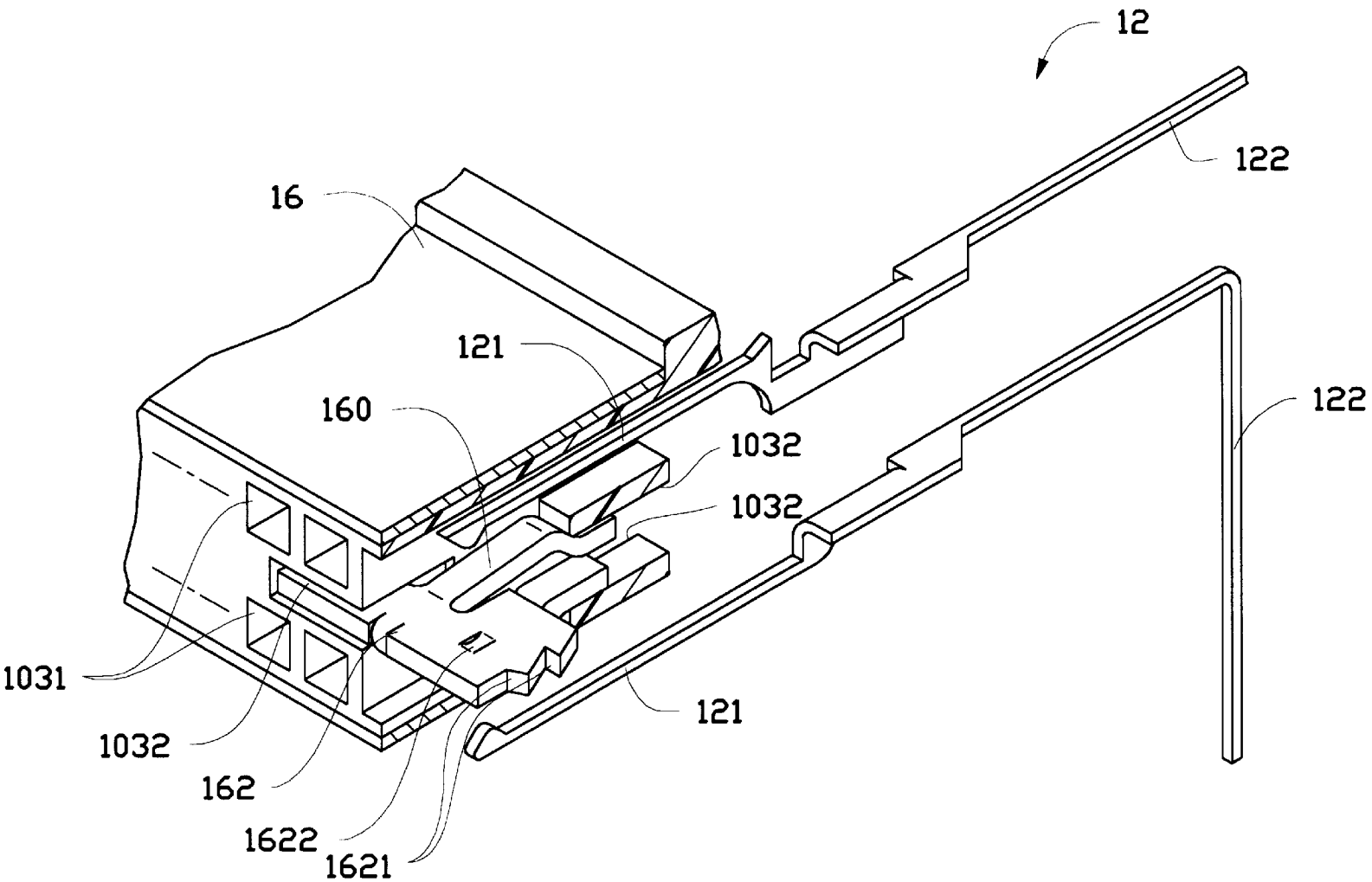
FIG. 2 shows a partially cut-away fragmentary perspective view of an electrical connector having detection means according to the present invention.
Figure 4:
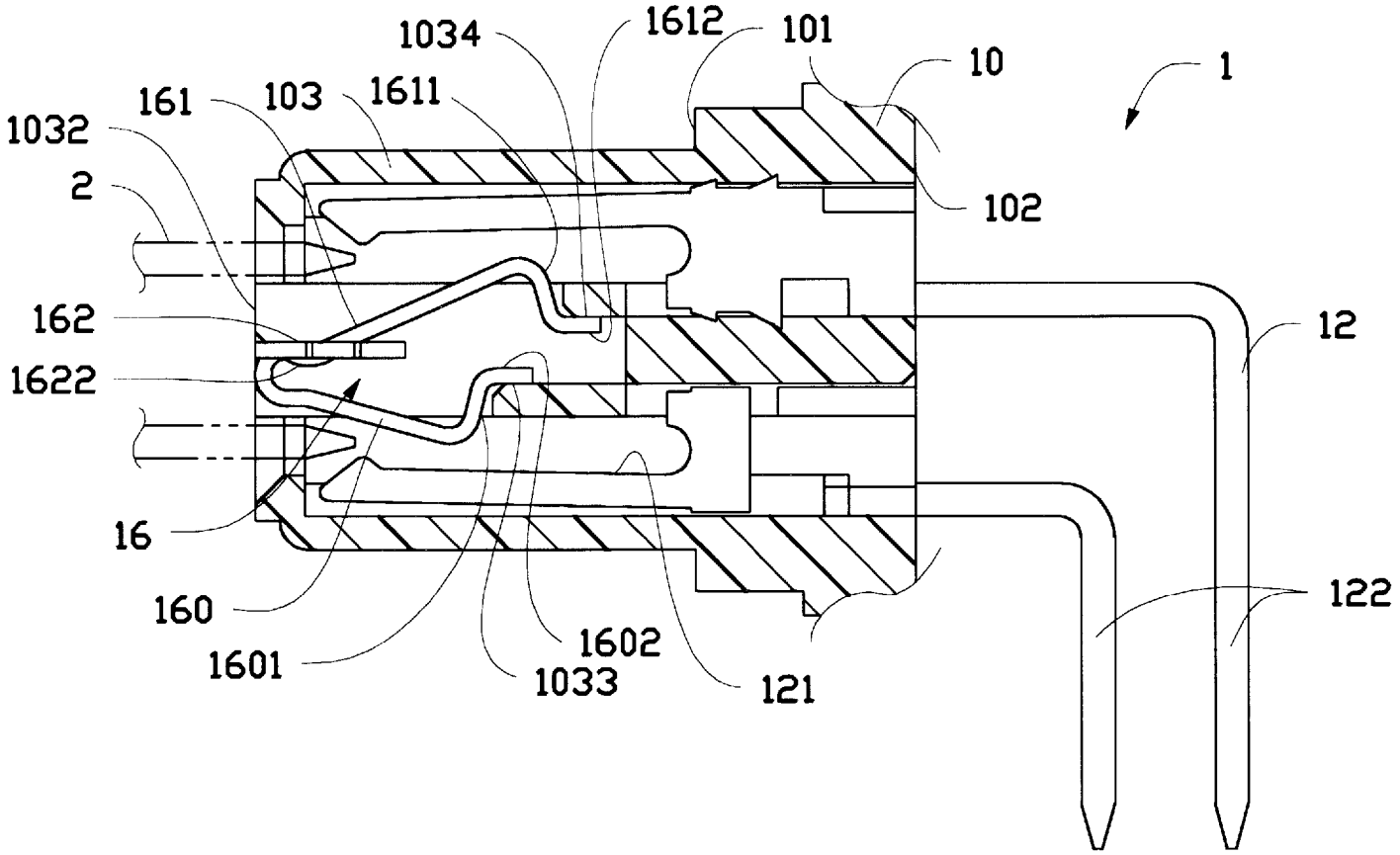
FIG. 4 shows a lateral cross-sectional view of detection means received in a housing for an electrical connector.

Referring to FIGS. 2 and 4, when positioning the detection means 16 into the horizontal slot 1032 of the mating body 103, the main plate 16 is inserted in to the horizontal slot 1032 with the lateral barbs interferingly fit into the side wall of the horizontal slot 1032 and the embossments 1622 urging on a lower surface of the horizontal slot 1032 to firmly securing in the mating body 103. The first and second contact legs 160, 161 extend into the horizontal slot 1032 and the end stoppers 1602, 1612 of the first and second legs 160, 161 abut against a lower and an upper shoulder 1033, 1034 formed on inner walls of the horizontal slot 1032, respectively. The outermost convex portions 1601, 1611 of the lower and the upper contact legs 160, 161 bulge out of the horizontal slot 1032 into the lower and the upper passageways 1031 for engaging mating contacts of a mating connector (not shown).

In one preferred embodiment, the rearward extending lengths of the first and the second contact legs 160, 161 may be different from each other. As shown in FIG. 4, the lower contact leg 160 is shorter than the upper contact leg 161. When a mating connector is inserted into the present connector 1, the lower contact leg 160 will be engaged first with a lower mating contact 2 (shown in phantom) of the mating connector for reducing noise by grounding. The upper contact leg 161 is then engaged with an upper mating contact 2 for transmitting an electrical signal to a circuit (not shown) for detecting whether the peripheral connected to the network system is in an on-line state and for reporting to a main circuit for reflecting the state to the system builder.

Since the contact legs 160, 161 are resilient, they will bend inward when pressed by the mating contacts, and return to their original position while the mating connector is removed.

Figure 5:
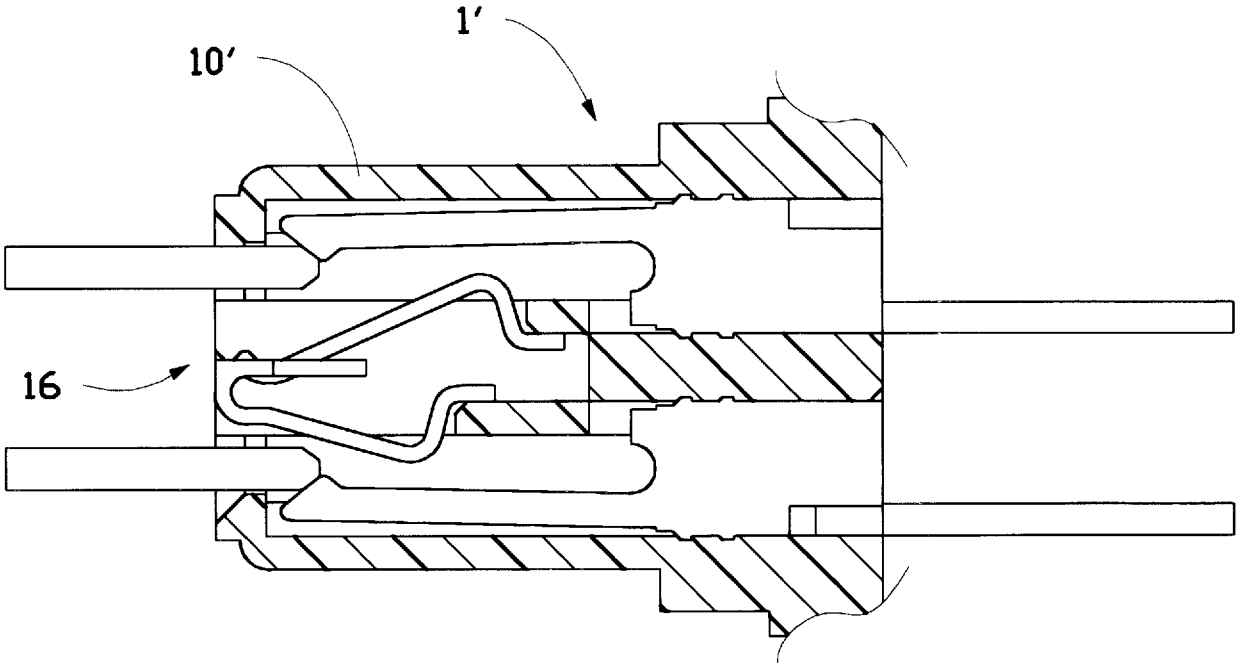
FIG. 5 shows a lateral cross-sectional view of detection means received in another housing for a vertical type electrical connector arrangement.

FIG. 5 shows another embodiment of the present invention, wherein the detection means 16 is received in a housing 10' for a vertical type electrical connector arrangement 1'. It can be seen that the detection means 16 and its arrangement to the housing 10' are completely the same as those in the housing 10 of the connector 1. The differences between the connectors 1 and 1' are the portions of the housing 10 and 10' which do not influence the structural relation between the detection means 16 and the housing 10 or 10'.

While the present invention has been described with reference to specific embodiments, the description is illustrative of the invention and is not to be construed as limiting the invention. Various modifications to the present invention can be made to the preferred embodiments by those skilled in the art without departing from the true spirit and scope of the invention as defined by the appended claims.

I claim:

1. An electrical connector, comprising:

an insulating housing including a mating body and a plurality of passageways defined in the mating body;

a plurality of conductive contacts received in said plurality of passageways; and detection means received in the mating body for detecting engagement of an external mating connector, said detection means including at least one contact leg for engagement with a conductive contact of a mating electrical connector, said at least one contact leg including a first contact leg for coupling to an external circuit and a second contact leg for grounding while engaging an conductive contact of a mating electrical connector.

2. The electrical connector as claimed in claim 1, wherein said first and second contact legs are so configured that said second contact leg engages with a mating conductive contact before said first contact leg engages with another mating conductive contact while a mating electrical connector being inserted into said electrical connector.

3. The electrical connector as claimed in claim 1, further comprising conductive shielding means conforming to a lateral surface of said mating body for prevention of electromagnetic interference.

4. The electrical connector as claimed in claim 1, further comprising an insulating plate configured to provide on said insulating housing and at a rear side of said mating body and a metal bracket for supporting said insulating housing and said insulating plate, said insulating plate including a plurality of vertical apertures for extending therethrough of a rear portion of said conductive contacts bent 90 degrees relative to a front portion thereof, said metal bracket defining a central opening for passing through of said mating body.

5. The electrical connector as claimed in claim 4, wherein said insulating housing further comprises a pair of insulating blocks extending rearward from both ends of said rear side of the mating body for securing said insulating housing and a metal bracket together.

6. The electrical connector as claimed in claim 5, wherein said insulating housing includes a mating surface and said mating body extends forward from the mating surface.

7. The electrical connector as claimed in claim 1, wherein said detection means comprises a main plate and said first and second contact legs extend from said main plate.

8. The electrical connector as claimed in claim 1, wherein said detection means is integrally formed by stamping and bending.

9. A detection means for an electrical connector, comprising:

a main plate for inserting into a slot of a housing of the electric connector;

first contact leg extending rearward from an edge of said main plate for engaging a conductive contact, and a second contact leg extending rearward from another edge of said main plate for engaging a conductive contact, wherein each of said first and second contact legs comprises an outward convex portion.

10. The detection means for the electrical connector as claimed in claim 9, wherein said first contact leg extend from a central portion of a front edge of said main plate and second contact legs extends from a central portion of a rear edge of said main plate opposite to said central portion of said front edge to form a V-shaped resilient structure.

11. The detection means for the electrical connector as claimed in claim 10, wherein each of said first and second contact legs comprises a V-shaped end portion having an end stopper.

12. The detection means for the electrical connector as claimed in claim 9, wherein said first and second contact legs are different in length.

13. The detection means for the electrical connector as claimed in claim 11, further comprising positioning means for positioning in a housing of the electrical connector.

14. The detection means for the electrical connector as claimed in claim 13, wherein said positioning means comprises a plurality of barbs on both lateral edges of said main plate.

15. The detection means for the electrical connector as claimed in claim 13, wherein said positioning means comprises a plurality of embossments on surfaces of said main plate.

16. The detection means for the electrical connector as claimed in claim 9, wherein said detection means is integrally formed by stamping and bending.

17. An arrangement of detection means in an insulating housing for an electrical connector, said housing comprising a plurality of passageways and a slot near at least one of said passageways and communicating with said at least one passageway;

at least one conductive contact received in said at least one passageway;

detection means including a main plate received in said slot and a first contact leg extending rearward from an edge of said main plate into an interior of said slot, said first contact leg having an outward convex portion bulging into said at least one passageway for engaging an external mating conductive contact inserted into said at least one passageway and a V-shaped end portion successively extending from the convex portion and having and end stopper abutting against a shoulder formed-on an inner wall of said slot.

18. An electrical connector, comprising:

an insulating housing including a mating body and a plurality of passageways defined in the mating body;

a plurality of conductive contacts received in said plurality of passageways; and detection means received in the mating body for detecting engagement of an external mating connector, said detection means including a main plate, a first contact leg extending from said main plate for coupling to a circuit on a mother board of a computer, and a second contact leg for grounding when said connector is mounted is mounted to said mother board and for engagement with a conductive contact of an external mating connector while engaging a mating conductive contact of a mating connector.

19. An arrangement of detection means in an insulating housing for an electrical connector, said housing comprising a plurality of passageways and a slot near a pair of said passageways and communicating with said pair of passageways;

at least one conductive contact received in said pair of passageways;

detection means including a main plate received in said slot, a first contact leg extending rearward from an edge of said main plate into an interior of said slot, and a second contact leg extending rearward from a second edge of said main plate into the interior of said slot, said first contact leg having an outward convex portion bulging into said at least one passageway for engaging an external mating conductive contact inserted into said at least one passageway and a V-shaped end portion successively extending from the convex portion and having and end stopper abutting against a shoulder formed on an inner wall of said slot, said second contact leg having an outward convex portion bulging into said at least one passageway for engaging an external mating conductive contact inserted into the other of said pair of passageways and a V-shaped end portion successively extending from the convex portion and having and end stopper abutting against a shoulder formed on an inner wall of said slot.

20. The electrical connector as claimed in claim 18, wherein said detection means comprises positioning means for positioning in a slot defined in said mating body.

21. The electrical connector as claimed in claim 20, wherein said positioning means comprises a plurality of barbs on both lateral edges of said main plate in interference fit with inner walls of said slot.

22. The electrical connector as claimed in claim 20, wherein said positioning means comprises a plurality of embossments on surfaces of said main plate in interference fit with inner walls of said slot.

23. The electrical connector as claimed in claim 22, wherein slot is defined between and communicates with a pair of aligned lower and upper passageways for receiving the first and second contact legs of said detection means to form a cross opening and said first and second contact legs comprise a convex portions, respectively, bulging into the pair of lower and upper passageways for engaging conductive contacts of a mating connector.

24. The electrical connector as claimed in claim 23, wherein said first and second contact legs further comprise an end stopper abutting against a lower and an upper shoulder formed on inner walls of said receiving slot, respectively.

25. The arrangement of detection means in the insulating housing for the electrical connector as claimed in claim 19, wherein said first and second contact legs are so configured that one of said first and second contact legs engages with a mating conductive contact before the other while a pair of mating conductive contacts being inserted into said pair of passageways.

26. The arrangement of detection means in the insulating housing for the electrical connector as claimed in claim 19, wherein said first contact leg extends from a front edge of said main plate and second contact legs extends from a rear edge of said main plate.

27. The arrangement of detection means in the insulating housing for the electrical connector as claimed in claim 26, wherein said first contact leg extends from a central portion of said front edge and said second contact leg extends from a central portion of said rear edge opposite to said central portion of said front edge to form a V-shaped resilient structure and said slot is formed between said pair of passageways to form a cross opening on the front surface of the mating body.

28. The electrical connector as claimed in claim 1, further comprising conductive shielding means conforming to a lateral surface of said mating body for prevention of electromagnetic interference;

an insulating plate configured to provide on said insulating housing and at a rear side of said mating body, said insulating plate including a plurality of vertical apertures for extending therethrough of a rear portion of said conductive contacts bent 90 degrees relative to a front portion thereof;

a metal bracket for supporting said insulating housing and said insulating plate, said metal bracket defining a central opening for passing through of said mating body; and a pair of insulating blocks extending rearward from both ends of said rear side of the mating body for securing said insulating housing and said metal bracket together.

29. The electrical connector as claimed in claim 1, wherein said detection means is provided for coupling to an electrical circuit of an electrical apparatus.

30. The electrical connector as claimed in claim 1, wherein said detection means is provided for coupling to an electrical circuit on a mother board of a computer.

* * * * *